United States Patent [19]

Cholin

[11] 4,222,045

[45] Sep. 9, 1980

[54] CAPACITIVE SHIFT FIRE DETECTION DEVICE

[75] Inventor: John M. Cholin, Hackensack, N.J.

[73] Assignee: Firetek Corporation, Hawthorne, N.J.

[21] Appl. No.: 30,269

[22] Filed: May 4, 1979

[51] Int. Cl.[2] ..... G08B 17/10

[52] U.S. Cl. ..... 340/628; 235/92 CA; 340/562; 340/658; 340/661

[58] Field of Search ..... 340/627, 628, 629, 562, 340/563, 661, 658; 250/381, 382, 384, 385, 379, 380, 389; 328/1; 235/92 FQ, 92 CA

[56] References Cited

U.S. PATENT DOCUMENTS

| | | | |
|---|---|---|---|
| 1,870,181 | 8/1932 | Mallory | 340/563 |
| 2,088,295 | 7/1937 | Hubble | 340/562 |
| 2,640,975 | 6/1953 | Roe et al. | 340/562 X |
| 2,832,950 | 4/1958 | Snyder | 340/562 X |
| 3,754,219 | 8/1973 | Klein | 340/627 X |

FOREIGN PATENT DOCUMENTS

| | | | |
|---|---|---|---|
| 1060295 | 6/1959 | Fed. Rep. of Germany | 340/562 |
| 27865 | 11/1969 | Japan | 340/628 |
| 529626 | 11/1940 | United Kingdom | 340/627 |
| 1333584 | 10/1973 | United Kingdom | 340/562 |

*Primary Examiner*—Donald J. Yusko
*Assistant Examiner*—Daniel Myer

[57] ABSTRACT

A capacitive shift fire detection device having a sample circuit and a reference circuit, each circuit having an air capacitor connected to an oscillator and a counter. The presence of particles of combustion in the ambient environment results in a change in the dielectric constant of the air dielectric of the sample capacitor, thus changing its capacitance. This change in capacitance is detected by an oscillator in the sample circuit, the mismatch of oscillators in the two circuits causing an exclusive OR-gate to go high, activating an alarm system.

1 Claim, 1 Drawing Figure

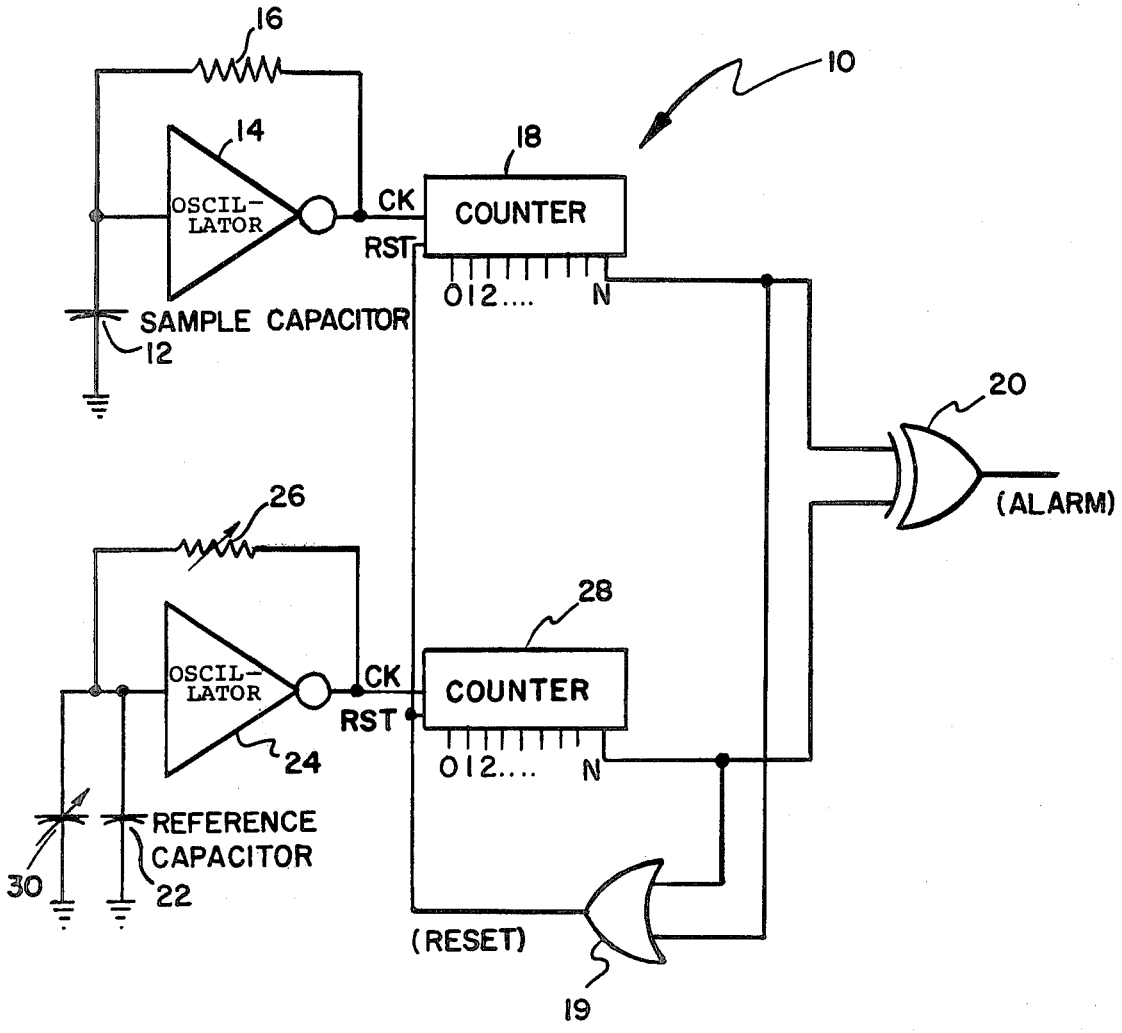
16
10
14
18
OSCIL-
LATOR
CK
COUNTER
RST
012....
N
SAMPLE CAPACITOR
12
20
(ALARM)
26
28
OSCIL-
LATOR
CK
COUNTER
RST
24
012....
N
REFERENCE
CAPACITOR
30
22
(RESET)
19

CAPACITIVE SHIFT FIRE DETECTION DEVICE

BACKGROUND OF THE INVENTION

1. Field of the Invention

This invention pertains to the field of fire detection devices, and in particular to those devices which detect the particles of combustion usually found in the ambient environment as smoke.

2. Description of the Prior Art

A fire detection device measures some parameter of the ambient conditions present in an environment and is designed to react to a change in the ambient conditions caused by the event of a fire, such as the presence of the molecular particles of combustion or the wavelength of light emitted by a flame.

Some fire detection devices use an ionization principle in which an electric current passing through the air is attenuated by the presence of heavy particles combustion and the change in current is detected by a detector, causing an alarm to sound. Other fire detection devices use a photoelectric principle in which the passage of light through the ambient air is impeded by the presence of particles of combustion and either scattered light or the simulation of another light beam is detected, either case causing an alarm to be sounded. A third type of fire detection device uses the electromagnetic radiation emitted by a fire to trip a photoelectric detection device based on the wavelength of the light emitted by the fire.

Fire detection devices using the ionization principle detect the presence of particles of combustion within an ionization chamber, which is built around a small radioactive source which bombards with ionization particles, whether alpha or beta particles. Consequently, the ambient air becomes ionized, thus having an unbalanced electric charge. These ions will migrate through the air and constitute a minute electric current of about fifty to one hundred picoamperes. As smoke particles enter the ionization chamber through a general Brownian motion, the particles, being larger and more massive, tend to aglomerate onto the ions. Having more mass and therefore more inertia, these particles do not move as readily through the air. Consequently, this lack of movement of the ions creates a drop in the current through the chamber, this drop is translated into a change in voltage across the chamber which is amplified through an ultra high input impedance amplifier. Ionization detectors have several shortcomings. The first is that the ionization chamber is sensitive to particles of a fairly small size range. It will not detect particles of combustion smaller than or larger than its size range. The ionization chamber depends on the probability that at some time in the development of a fire from an incipient noncombustion hotspot to a raging fire, the fire will at some time produce particles of combustion of the size which the ionization chamber can detect. This size range is usually from 0.1/micron to one (1.0) micron. The ionization chamber is also susceptible to false alarms due to aerosols being injected into the air. Ammonia and synthetic cleaning agents are known for their ability to set off ionization detectors. Ionization dectectors are also affected by the velocity of air passing through the ionization chamber which can cause the ionic particles to be blown away faster than they are generated. While modern ionization detectors have been designed to minimize these problems, the problems still remain.

The photoelectric detectors also have some shortcomings. They are usually sensitive only to larger particles which are produced in later stages of combustion. Hence, they are slower to respond than the ionization type detectors. They also suffer from reliability problems. And it is necessary to keep all ambient light out of the photo-labyrinth. The labyrinth is heavily occluded and the passage of air within it is impeded. Hence, the photoelectric detector will be slow to respond to a combustion situation.

Detectors using electromagnetic radiation also have problems. These detectors sense ultraviolet or infrared radiation emitted from a fire and use this radiation to trip a detector. However, they are limited by the sensitivity of the photodetecting devices available. There are many spurious sources of infrared radiation and some of ultraviolet radiation. These devices are typically less sensitive than others and more prone to false alarms.

Of all the prior art detectors, the ionization chamber is the most sensitive. Even in its most sophisticated embodiments, it still suffers from two shortcomings. It requires a radioactive material and it cannot be used in an environment in which the ambient air must be moved rapidly.

The object of the present invention is to provide a fire detection device which is as sensitive as the ionization chamber, which does not use a radioactive material, which can be used effectively when the ambient air is moving, which does not have electronic design problems and which is safe and inexpensive.

SUMMARY OF THE INVENTION

This invention pertains to a capacitive shift fire detection device which senses a shift in the dielectric constant of air which results from the accumulation of particles of combustion in the air. The device uses a reference capacitor and a reference oscillator to counteract normal variations in the ambient environment. A sampling capacitor will change in capacitance with the presence of particles of combustion and its change in capacitance is detected by a free running oscillator. The reference oscillator is tuned to the frequency of the sampling oscillator in the normal environment and each oscillator is connected to a counter. As each counter reaches a predetermined count, an OR-gate is tripped to reset them. At the same time they pulse an exclusive OR-gate. In the absence of combustion, both oscillators will operate at the same frequency, both counters will reach the end of their counter widths at the same time and the exclusive OR-gate will receive two equal pulses. However, if particles of combustion are present, the capacitance of the sampling capacitor will shift, causing a mismatch in frequency between the reference and the sampling oscillators and hence in their counters. If there is a frequency mismatch from the counters, the exclusive OR-gate will have a high output and trip an alarm.

The capacitive shift detector is very reliable because the dielectric constant of air is relatively stable, varying somewhat with temperature and humidity. However, the reference capacitor can compensate for these variations. The capacitance of any capacitor will vary as the dielectric constant of its dielectric varies. The dielectric constant of air is varied by an influx of paricles of combustion. In the sampling capacitor, this will result in a change of capacitance which is detected by its free running oscillator. A shift in frequency in the free running oscillator signals a shift in capacitance in the sampling capacitor.

The capacitive shift fire detection device of the present invention is thus a gaseous detection device which is not affected by the velocity of moving air and which can be made out of simple solid state electronic components and a fairly rugged transducer.

BRIEF DESCRIPTION OF THE DRAWING

The FIGURE is a schematic circuit drawing of the capactive shift fire detection device of the present inventio

DESCRIPTION OF THE PREFERRED EMBODIMENT

Referring now to the drawing which is a schematic circuit of the capacitive shift fire detection device 10 of the present invention, two parallel circuits are shown. In the upper circuit there is a sample capacitor 12 which is an air capacitor which is exposed to the ambient environment. The sample capacitor is connected to a solid state oscillator 14 shunted by a feedback resistor 16, the output of the oscillator 14 feeding a solid state counter 18. Counter 18 is connected to both an OR-gate 19 and exclusive OR-gate 20. In the lower circuit, which essentially parallels the upper circuit, there is a reference capacitor 22, also an air capacitor, but reference capacitor 22 is essentially closed away from rapid changes in the ambient environment. However reference capacitor 22 cannot be fully sealed from the ambient environment because its dielectric constant must be sensitive to changes in temperature and relative humidity. Reference capacitor 22 is connected to a solid state oscillator 24 shunted by a feedback resistor 26, the output of the oscillator 24 feeding a counter 28. Counter 28 is also connected to OR-gate 19 and exclusive OR-gate 20. Oscillators 14, 24 are basically solid state logic gates. Counters 18, 28 are arrays of solid state logic gates, each of which has a width of sixteen bits, for example. Typically, solid state oscillators made up of logic gates have some drift due to the resistors and capacitors in their timing circuits, but that does not affect device 10. Sample capacitor 12 and reference capacitor 14 are essentially identical and both will be affected by changes in the ambient environment equally. Resistors 16, 26 should be essentially the same in value. With essentially identical capacitors 12, 22 and resistors 16, 26, oscillators 14, 24 should oscillate with essentially the same frequencies. To balance the two parallel circuits, trimming components are provided on the reference side. A trimming capacitor 30 is provided and resistor 26 is trimmable. The frequency of the reference oscillator 24 is trimmed to match that of the sample oscillator 14. As oscillators 14, 24 oscillate at substantially identical frequencies, they each trip their respective counters 18, 28 simultaneously, the clock frequency of the counters being at essentially the same frequency. Consequently the counters 18, 28 will be stepped simultaneously. As each counter reaches the end of its counter width, which is typically sixteen bits, the last pins will go high simultaneously, OR-gate 20 will be low on its output, which serves as input to an alarm circuit. If there is no frequency mismatch in the two oscillators 14, 24, counters 18, 28 will feed identical inputs to exclusive OR-gate 20 so that its output will be low. If there is a frequency mismatch in oscillators 14, 24, one counter would have a high output and the other counter would have a low output, causing exclusive OR-gate to have a high output, thereby tripping the alarm circuit. The frequency mismatch would be caused by the presence of particles of combustion in the ambient environment, causing a change in the dielectric constant of sample capacitor 12, thereby changing its capacitance and hence changing the frequency of oscillator 14.

Capacitive shift fire detection device 10 is able to sense very small changes in frequency and consequently very small changes in the dielectric constant of air. Typically, a one percent change in the dielectric constant of air would cause a frequency mismatch resulting in a ninety nanosecond high logic output at exclusive OR-gate 20. Also it is not affected by the velocity of the air, which makes it considerably more reliable in environments in which air must be kept moving. Device 10 has no electronic leakage, requires no radioactive material, and can be easily adjusted for parasitic resistances and capacitances. To this extent the capacitive shift fire detection device is a substantial improvement over the ionization detectors. The only common problem not resolved is that of the aerosols. However, since both types of devices are usually used in controlled environments, this problem is not a significant liability.

The capacitive shift detector solves a number of problems in the fire detection field. The oscillating system can have a higher degree of stability and a higher degree of noise immunity than a steady solid state DC system. The capacitive shift detector has an intrinsic filtering tendency, so that R.F.I. generated in the environment does not affect the detector. The capacitive shift detector takes into account the entire spectrum of particle sizes, thus eliminating the lack of sensitivity to certain particle sizes of other types of detectors. The capacitive shift detector is not affected by particle size, but by its dielectric characteristics. Thus is solves most of the problems of ionization and photoelectric detectors. The capacitive shift detector does not have to be shielded, or have any parts inaccessible. It is not sensitive to particle size, air velocity or light.

While I have described and illustrated on embodiment of my invention, many other embodiments may occur to those skilled in the art. My invention is defined by the scope of the following claims.

I claim:

1. A capacitive shift fire detection device comprising:
   - a sample capacitor having air as its dielectric fully exposed to the ambient environment;
   - a firsr oscillator connected to said sample capacitor;
   - a feedback resistor connected to the output of said first oscillator and said sample capacitor;
   - a first counter to count the frequency of said first oscillator;
   - an OR-gate to reset said first counter at the end of a counting cycle;
   - an exclusive-OR-gate connected to the output of said first counter and leading to an alarm signal;
   - a reference capacitor having air as its dielectric partially sealed from the ambient environment such that the dielectric constant of the air dielectric is affected only by the temperature and humidity of the environment;
   - said reference capacitor being substantially identical to said first capacitor;
   - a second oscillator connected to said reference capacitor;
   - said second oscillator being substantially identical to said first oscillator;

a trimmable feedback resistor connected between said second capacitor and the output of said second oscillator to tune said second oscillator to the frequency of said first oscillator;

a second counter to count the frequency of said second oscillator;

said second counter being substantially identical to said first counter;

said second counter also being reset by said OR-gate at the end of a counting cycle;

said second counter also serving as an input to said exclusive OR-gate;

said exclusive OR-gate serving as input to an alarm circuit;

a match in frequency of said oscillators resulting in the output of said first and second counters being high simultaneously and the output of said exclusive OR-gate being low such that said alarm circuit is not activated;

a mismatch in frequency of said oscillators resulting in the output of one of said counters being high while the other is low and the output of said exclusive OR-gate being high, causing said alarm circuit to be activated;

said mismatch in frequency of said oscillators resulting from a change in capacitance in said sample capacitor resulting from a change in dielectric constant of its air dielectric resulting from the presence of particles of combustion in the ambient air.

* * * * *